US011126138B2

(12) United States Patent
Boettcher et al.

(10) Patent No.: US 11,126,138 B2
(45) Date of Patent: Sep. 21, 2021

(54) BUSHING ASSEMBLY FOR AN ELECTROPHOTOGRAPHIC IMAGE FORMING DEVICE

(71) Applicant: LEXMARK INTERNATIONAL, INC., Lexington, KY (US)

(72) Inventors: Brian Lester Boettcher, Versailles, KY (US); Brian Lee Hawes, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/985,452

(22) Filed: Aug. 5, 2020

(65) Prior Publication Data

US 2021/0063955 A1 Mar. 4, 2021

Related U.S. Application Data

(60) Provisional application No. 62/892,752, filed on Aug. 28, 2019.

(51) Int. Cl.
*G03G 21/16* (2006.01)
*B65H 29/20* (2006.01)

(52) U.S. Cl.
CPC ..... *G03G 21/1676* (2013.01); *B65H 29/20* (2013.01); *B65H 2402/5211* (2013.01); *B65H 2402/5221* (2013.01); *G03G 2221/163* (2013.01)

(58) Field of Classification Search
CPC ..... G03G 15/0896; G03G 15/0898; G03G 21/1676; G03G 2221/163; B65H 29/20; B65H 2402/5211; B65H 2402/5221
See application file for complete search history.

(56) References Cited

U.S. PATENT DOCUMENTS

| | | | | |
|---|---|---|---|---|
| 6,816,692 | B1 | 11/2004 | Kerley et al. | |
| 7,330,680 | B2 | 2/2008 | Bryant et al. | |
| 8,380,106 | B2 | 2/2013 | Gayne et al. | |
| 9,152,089 | B1 * | 10/2015 | Denton | |
| 9,851,652 | B2 | 12/2017 | Gilliam et al. | |
| 2009/0010678 | A1 * | 1/2009 | Kim | 399/111 |
| 2009/0245934 | A1 * | 10/2009 | Han | G03G 15/0808 403/342 |
| 2013/0322921 | A1 * | 12/2013 | Maeshima | G03G 15/0898 399/111 |

(Continued)

*Primary Examiner* — Sophia S Chen

(57) ABSTRACT

An assembly for an electrophotographic image forming device includes a housing and a rotatable component. A bushing has an opening defined by an inner circumferential surface of the bushing. A shaft of the rotatable component is received in the opening such that the inner circumferential surface rotatably supports the shaft. A first mating feature is positioned on an outer surface of the bushing that is opposite the inner circumferential surface of the bushing. The first mating feature is positioned between an inner axial end of the bushing and an outer axial end of the bushing relative to a rotational axis of the rotatable component. The first mating feature of the bushing is in contact with a second mating feature on the housing. Contact between the first and second mating features defines an axial position of the bushing relative to the housing along the rotational axis of the rotatable component.

20 Claims, 11 Drawing Sheets

(56) References Cited

U.S. PATENT DOCUMENTS

| | | | | |
|---|---|---|---|---|
| 2014/0072328 | A1* | 3/2014 | Kanno | G03G 15/0898<br>399/103 |
| 2018/0136604 | A1* | 5/2018 | Lee | G03G 15/0173 |
| 2018/0364608 | A1* | 12/2018 | Momoka | G03G 15/087 |

* cited by examiner

BUSHING ASSEMBLY FOR AN ELECTROPHOTOGRAPHIC IMAGE FORMING DEVICE

CROSS REFERENCES TO RELATED APPLICATIONS

This application claims priority to U.S. Provisional Patent Application Ser. No. 62/892,752, filed Aug. 28, 2019, entitled "Bushing Assembly for an Electrophotographic Image Forming Device," the content of which is hereby incorporated by reference in its entirety.

BACKGROUND

1. Field of the Disclosure

The present disclosure relates generally to image forming devices and more particularly to a bushing assembly for an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper)) either directly by the photoconductive drum or indirectly by an intermediate transfer member. The toner is then fused to the media using heat and pressure to complete the print.

Various rotatable imaging components, such as a developer roll, are typically provided on one or more replaceable units permitting periodic replacement of the imaging components over the life of the image forming device. It is desired to provide a replaceable unit construction that minimizes manufacturing complexity. Compact components are also desired in order to meet consumer preferences for smaller devices.

SUMMARY

An assembly for an electrophotographic image forming device according to one example embodiment includes a housing and a rotatable component. The rotatable component has a shaft that defines a rotational axis of the rotatable component. A bushing has an opening defined by an inner circumferential surface of the bushing. The shaft is received in the opening such that the inner circumferential surface of the bushing rotatably supports the shaft. The bushing is installed on the housing and is separable from the housing. A first mating feature is positioned on an outer surface of the bushing that is opposite the inner circumferential surface of the bushing. The first mating feature is positioned between an inner axial end of the bushing and an outer axial end of the bushing relative to the rotational axis of the rotatable component. The first mating feature of the bushing is in contact with a second mating feature on the housing. Contact between the first and second mating features defines an axial position of the bushing relative to the housing along the rotational axis of the rotatable component.

A developer unit for an electrophotographic image forming device according to another example embodiment includes a housing and a rotatable developer roll. The developer roll has a shaft that defines a rotational axis of the developer roll. A bushing has a cylindrical opening that extends through the bushing from an inner axial end of the bushing to an outer axial end of the bushing. The shaft extends through the cylindrical opening such that the bushing rotatably supports the shaft. The bushing is installed on a recess in the housing and is separable from the housing. The recess is defined by a concave surface of the housing. A groove is formed in an outer surface of the bushing and runs circumferentially relative to the rotational axis of the developer roll. The groove is positioned between the inner axial end of the bushing and the outer axial end of the bushing. The groove matably receives a tooth that projects from the concave surface of the housing. Contact between the tooth and a surface of the bushing in the groove defines an axial position of the bushing relative to the housing along the rotational axis of the developer roll.

A developer roll bushing for an electrophotographic image forming device according to one example embodiment includes a body attachable to a housing in the electrophotographic image forming device. A cylindrical opening extends through the body from an inner axial end of the body to an outer axial end of the body for receiving and rotatably supporting a shaft of a developer roll. The cylindrical opening is defined by an inner circumferential surface of the body. A groove is formed in an outer surface of the body that is opposite the inner circumferential surface of the body. The groove runs circumferentially relative to a central axis of the cylindrical opening. The groove is positioned between the inner axial end of the body and the outer axial end of the body. The groove is positioned to matably receive a tooth on the housing to define an axial position of the developer roll bushing relative to the housing along the central axis of the cylindrical opening.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
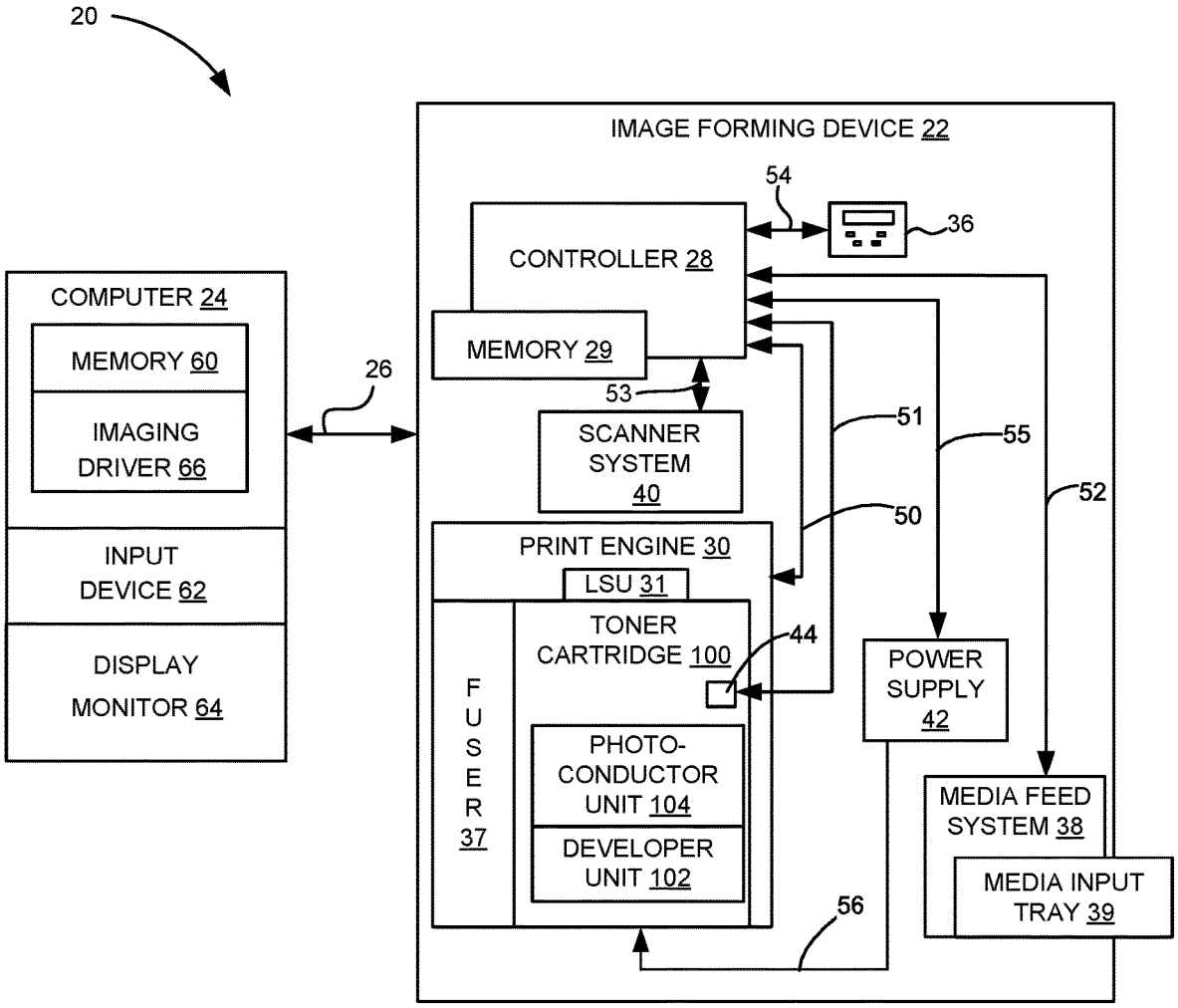
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In the example embodiment illustrated, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
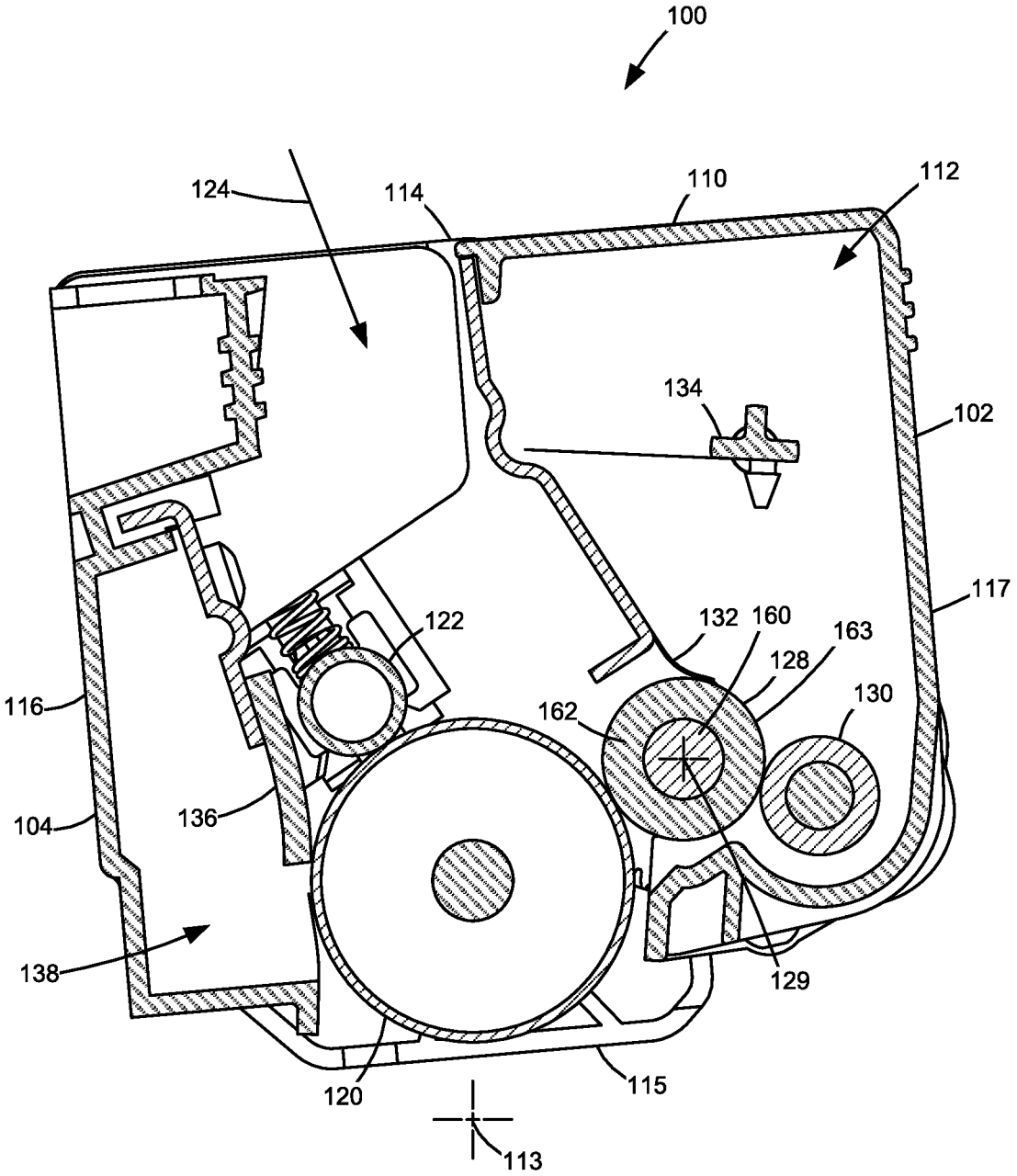
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. Housing 110 generally includes various elements that form the overall body and support structure of toner cartridge 100 including, for example, one or more main body portions, end caps, lids, gear plates, etc. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media. (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
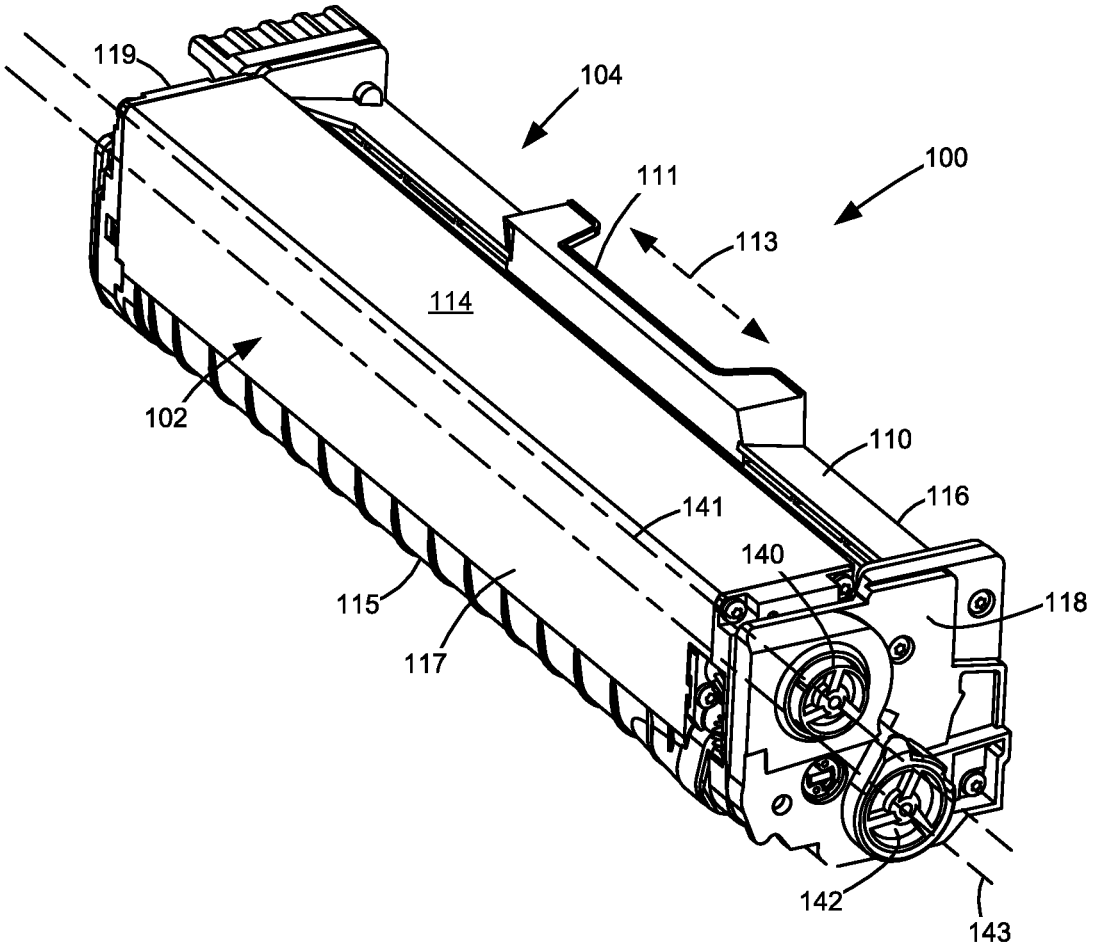
FIGS. 3 and 4 are perspective views of the toner cartridge according to one example embodiment.
Figure 4:
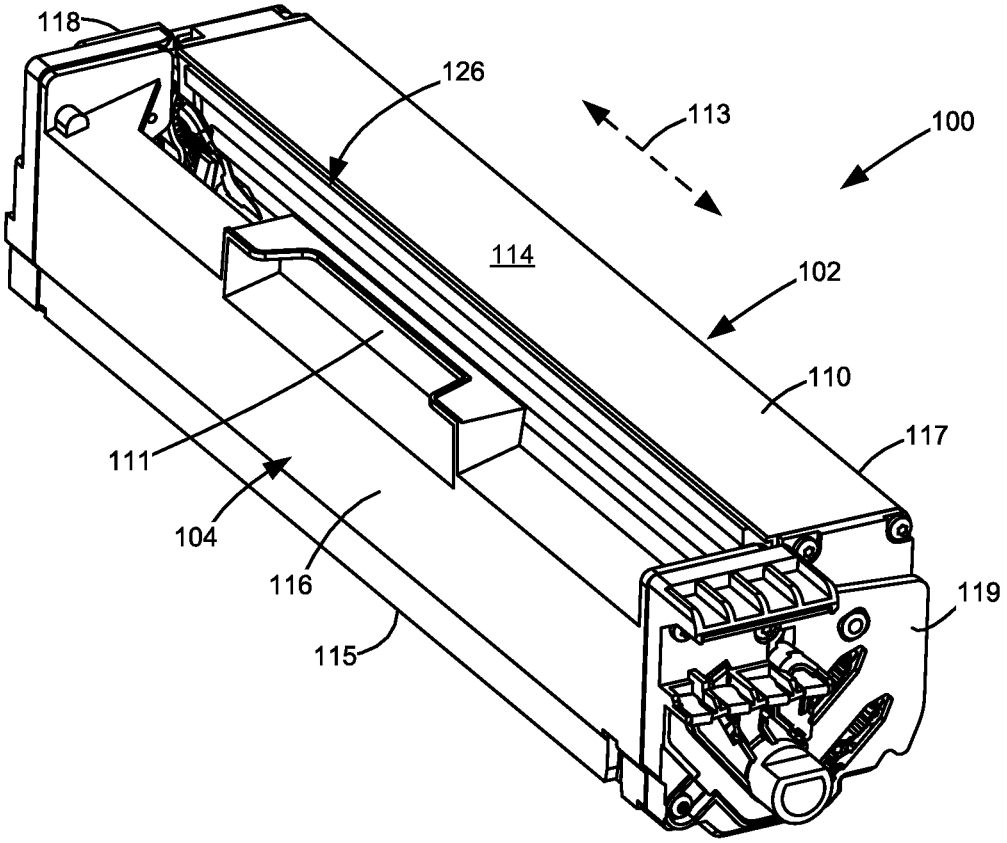
Figure 5:
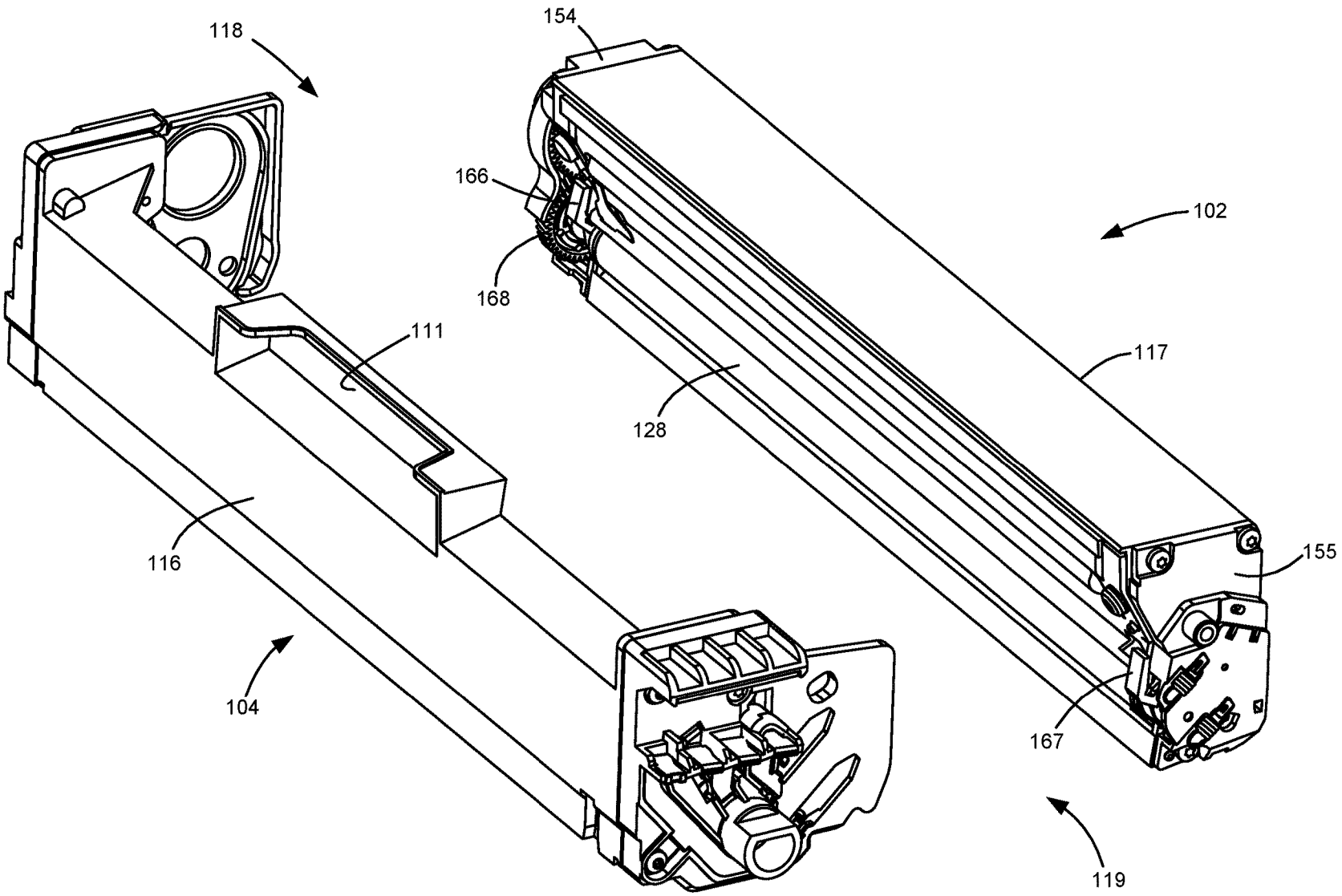
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110 and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

With reference to FIG. 3, in the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110. Each drive coupler 140, 142 includes a rotational axis 141, 143. Each drive coupler 140, 142 includes a force receiving portion that mates with and receives rotational motion from the corresponding drive couplers in image forming device 22. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

Figure 6:
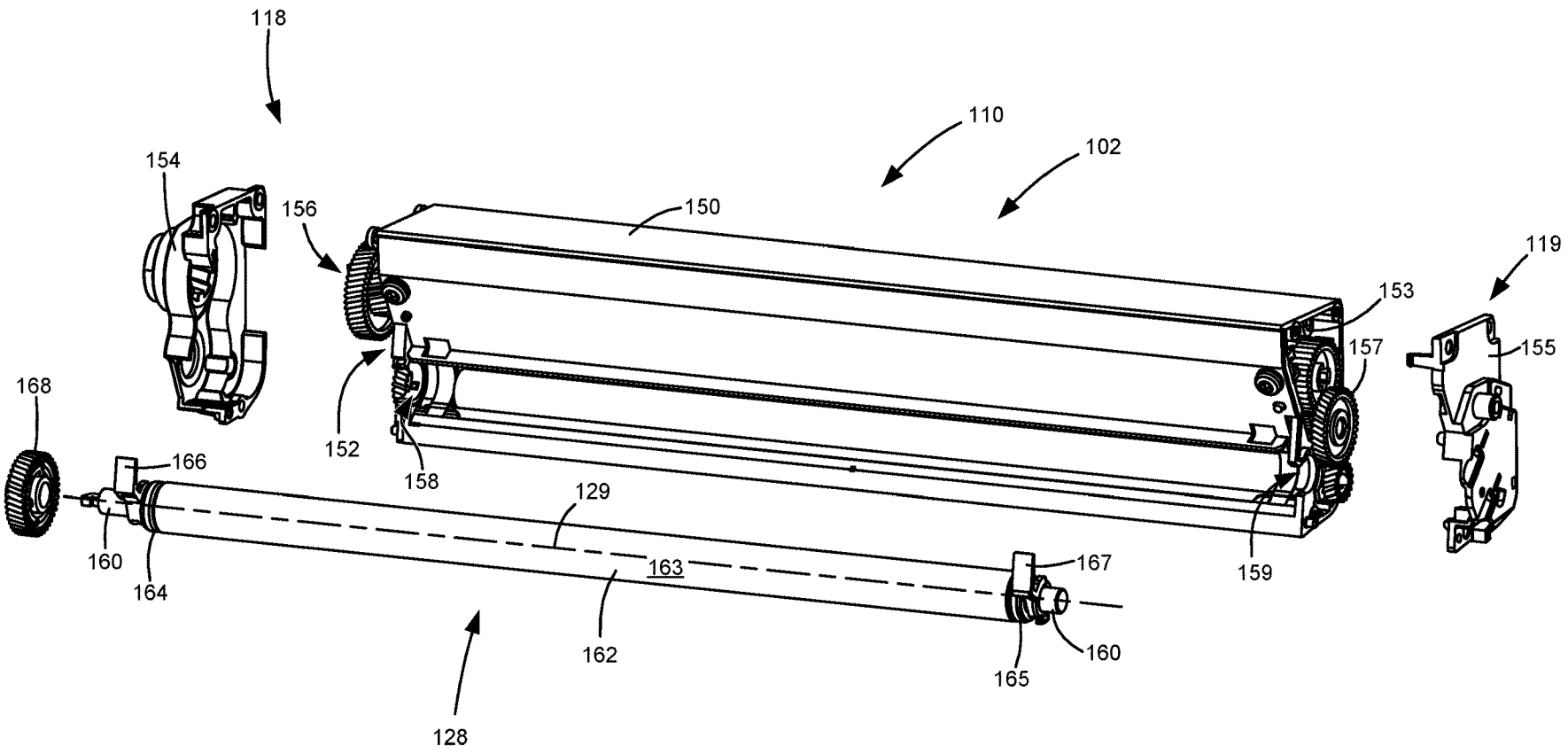
FIG. 6 is an exploded view of the developer unit of the toner cartridge according to one example embodiment.

With reference to FIG. 6, in the example embodiment illustrated, housing 110 includes a main body portion 150 of developer unit 102 and a gear plate 152, 153 positioned at each end 118, 119 of main body portion 150. In this embodiment, housing 110 also includes an end cap 154, 155 mounted to gear plate 152, 153 and/or main body portion 150 at each end 118, 119 of housing 110. Each end cap 154, 155 covers and helps retain a respective drive train 156, 157 positioned between the end cap 154, 155 its adjacent gear plate 152, 153. In the example embodiment illustrated, drive train 156 at end 118 of housing 110 includes gears that transfer rotational motion from drive coupler 140 to developer roll 128 and toner adder roll 130 and drive train 157 at end 119 of housing 110 includes gears that transfer rotational motion from toner adder roll 130 to toner agitator 134. However, any suitable gear arrangement may be used to transfer rotational motion from one or more drive couplers to various rotatable components of developer unit 102 as desired.

FIG. 6 shows developer roll 128 separated from housing 110 to more clearly illustrate the components of developer roll 128. Developer roll 128 includes a shaft 160 that defines a rotational axis 129 of developer roll 128. A roll body 162 is cylindrically disposed around shaft 160 and forms an outer surface 163 of developer roll 128. In the embodiment illustrated, a pair of spacers 164, 165 are positioned around shaft 160 at opposite axial ends of roll body 162. Spacers 164, 165 are positioned to contact an outer surface of photoconductive drum 120. Contact between spacers 164, 165 and outer surface of photoconductive drum 120 defines a fixed amount of interference between roll body 162 of developer roll 128 and photoconductive drum 120 during operation. In this manner, spacers 164, 165 limit an amount of compression of roll body 162 at a nip formed between outer surface 163 of developer roll 128 and the outer surface of photoconductive drum 120.

A pair of bushings 166, 167 are positioned around shaft 160 of developer roll 128 axially outboard of roll body 162 and spacers 164, 165. Each bushing 166, 167 includes a respective opening through which shaft 160 passes permitting shaft 160 to rotate relative to bushings 166, 167 during operation. Bushings 166, 167 rotatably support developer roll 128 and locate rotational axis 129 of developer roll 128 relative to housing 110. Each bushing 166, 167 is separable from housing 110, i.e., bushings 166, 167 are not formed integrally with housing 110, permitting the assembly of bushings 166, 167 onto shaft 160 prior to assembly of developer roll 128 onto housing 110. When developer roll 128 is installed on housing 110, each bushing 166, 167 is matably received in a corresponding recess 158, 159 at a respective end 118, 119 of housing 110 as discussed in greater detail below. A drive gear 168 is rotatably coupled to an end portion of shaft 160 proximate to end 118 of housing 110 such that rotation of drive gear 168 causes rotation of shaft 160 and roll body 162.

Figure 7A:
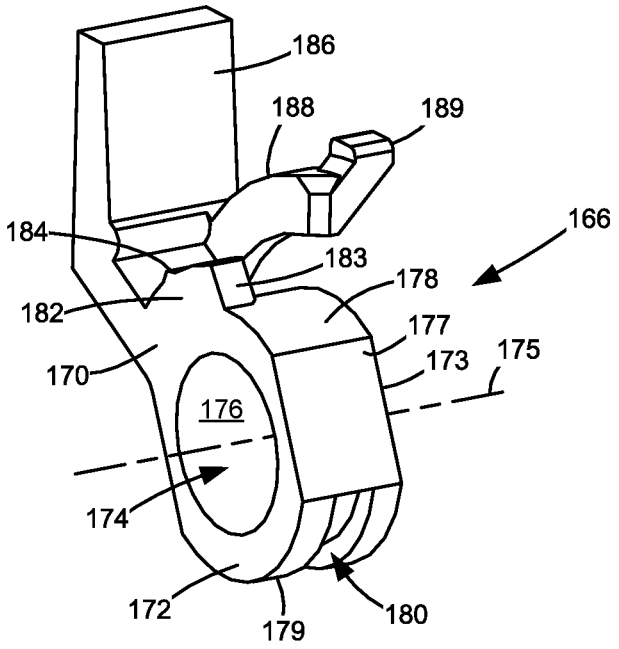
FIGS. 7A and 7B are perspective views of a developer roll bushing according to one example embodiment.
Figure 7B:
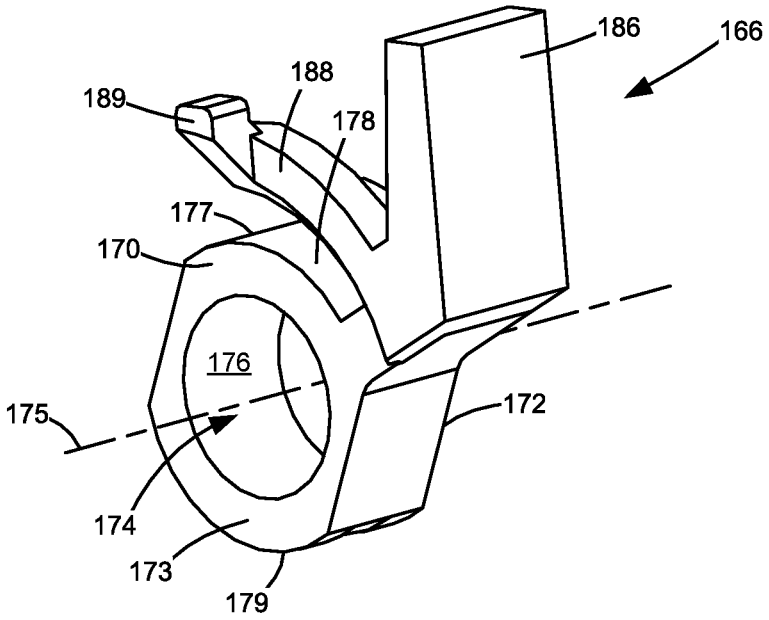

FIGS. 7A and 7B show bushing 166 in greater detail according to one example embodiment. Bushing 166 includes a body 170 having an inner axial end 172 and an outer axial end 173. A cylindrical opening 174 extends through body 170 from inner axial end 172 to outer axial end 173. Opening 174 is configured to closely receive shaft 160 of developer roll 128 permitting bushing 166 to rotatably support shaft 160 near an axial end of shaft 160. Opening 174 is defined by an inner circumferential surface 176 that contacts and rotatably supports shaft 160 of developer roll 128 and during operation. Body 170 further includes an outer surface 177 that is formed between inner axial end 172 and outer axial end 173 and that is opposite inner circumferential surface 176 of opening 174 such that outer surface 177 faces away from a central axis 175 of opening 174 (and rotational axis 129 of developer roll 128). Outer surface 177 may take many suitable shapes. For example, in the embodiment illustrated, outer surface 177 includes both arched portions and planar portions. Body 170 includes an upper portion 178 and a lower portion 179 relative to top 114 and bottom 115 of housing 110 when bushing 166 is installed on housing 110.

A positioning groove 180 is formed in outer surface 177 on lower portion 179 of body 170, Groove 180 runs circumferentially relative to central axis 175 of opening 174 (and to rotational axis 129 of developer roll 128). In the embodiment illustrated, a centerline of groove 180 has a constant axial position relative to central axis 175 of opening 174. Groove 180 aids in positioning bushing 166 relative to housing 110 along an axial dimension of developer roll 128 as discussed in greater detail below.

A latching projection 182 extends radially outward relative to central axis 175 of opening 174 from outer surface 177 on upper portion 178 of body 170. In the embodiment illustrated, projection 182 is positioned at inner axial end 172 of body 170. In this embodiment, projection 182 includes a bump formed on a raised portion 183 of outer surface 177, such as, for example, a triangular projection or bump 184 that contacts a corresponding catch on housing 110 in order to position bushing 166 rotationally relative to housing 110 as discussed in greater detail below.

Bushing 166 includes a handle 186 that extends from outer surface 177 on upper portion 178 of body 170. Handle 186 is configured to permit an assembly technician to manually grasp handle 186 during assembly of bushings 166, 167 and developer roll 128 onto housing 110 as discussed in greater detail below.

Bushing 166 also includes an arm 188 that extends circumferentially relative to central axis 175 of opening 174 from handle 186 in a spaced relationship with outer surface 177 on upper portion 178 of body 170. In the embodiment illustrated, arm 188 is positioned at outer axial end 173 of body 170 and extends further outward axially than the portion of outer axial end 173 of body 170 surrounding opening 174. Arm 188 provides an installation guide that aids an assembly technician with installing bushing 166 on housing 110 as discussed in greater detail below. A projection 189 extends outward axially from arm 188 and is configured to prevent an assembly technician from inadvertently installing bushing 166 at end 119 of housing 110 instead of end 118 of housing 110. In particular, projection 189 is positioned to interfere with one or more components if installation at end 119 of housing 110 is attempted thereby preventing installation of bushing 166 at end 119 of housing 110.

Figure 8:
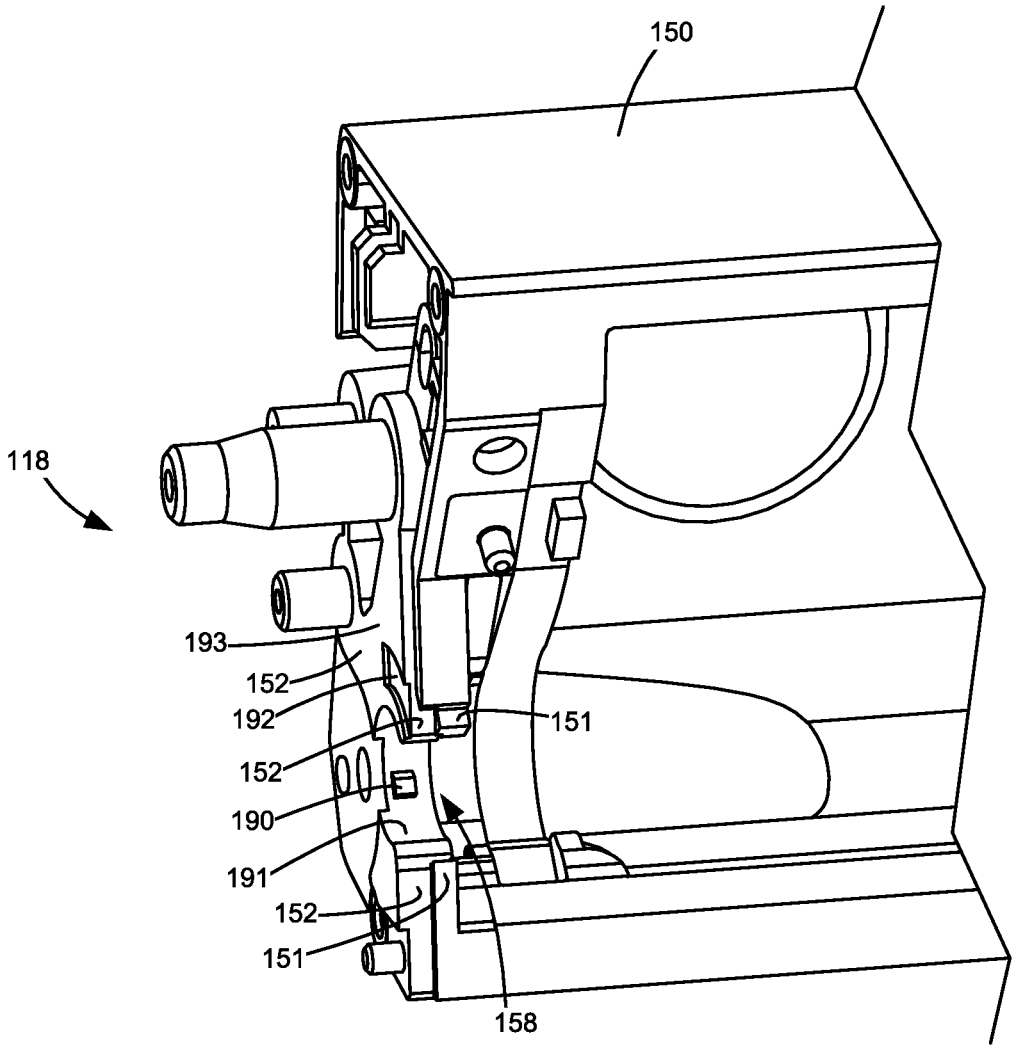
FIG. 8 is a perspective view of a main body portion of the developer unit and a gear plate according to one example embodiment.

FIG. 8 shows main body portion 150 and gear plate 152 at end 118 of housing 110 in greater detail according to one example embodiment. In the example embodiment illustrated, recess 158 that receives bushing 166 is formed in both an end wall 151 of main body portion 150 and gear plate 152 with portions of both end wall 151 and gear plate 152 contacting bushing 166. As shown in FIG. 8, a portion of gear plate 152 forming recess 158 extends axially inward and overlaps axially with end wall 151 of main body portion 150. A tooth 190 extends from a concave surface 191 of gear plate 152 that forms a portion of recess 158. Tooth 190 extends radially inward from gear plate 152 relative to rotational axis 129 of developer roll 128. Tooth 190 matably engages groove 180 of bushing 166 when bushing 166 is installed on housing 110 in order to position bushing 166 relative to housing 110 along an axial dimension of developer roll 128 as discussed in greater detail below. In the example embodiment illustrated, a recess 192 is formed on an outer axial surface 193 of gear plate 152. Recess 192 is positioned to receive arm 188 of bushing 166 during installation of bushing 166 onto housing 110 in order to help guide the assembly of bushing 166 onto housing 110.

Figure 9:
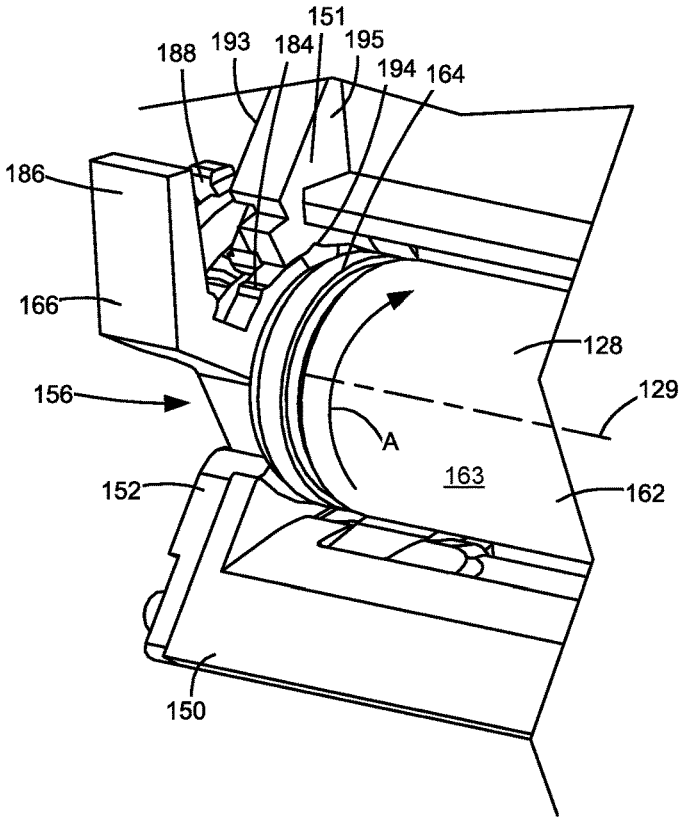
FIG. 9 is a perspective view showing installation of the developer roll bushing onto the developer unit according to one example embodiment illustrated.

With reference to FIG. 9, to assemble developer roll 128 onto housing 110, an assembly technician positions a developer roll subassembly (which includes roll body 162, spacers 164, 165 and bushings 166, 167 assembled onto shaft 160) onto housing 110 with bushings 166, 167 positioned in recesses 158, 159 on housing 110 and roll body 162 of developer roll 128 generally in its operative position relative to housing 110 as shown in FIG. 9. The assembly technician then rotates bushings 166, 167, e.g., by grasping handle 186 of bushing 166 and a similar handle of bushing 167) upward as indicated by the arrow A in FIG. 9, toward the final, installed positions of bushings 166, 167.

Figure 10:
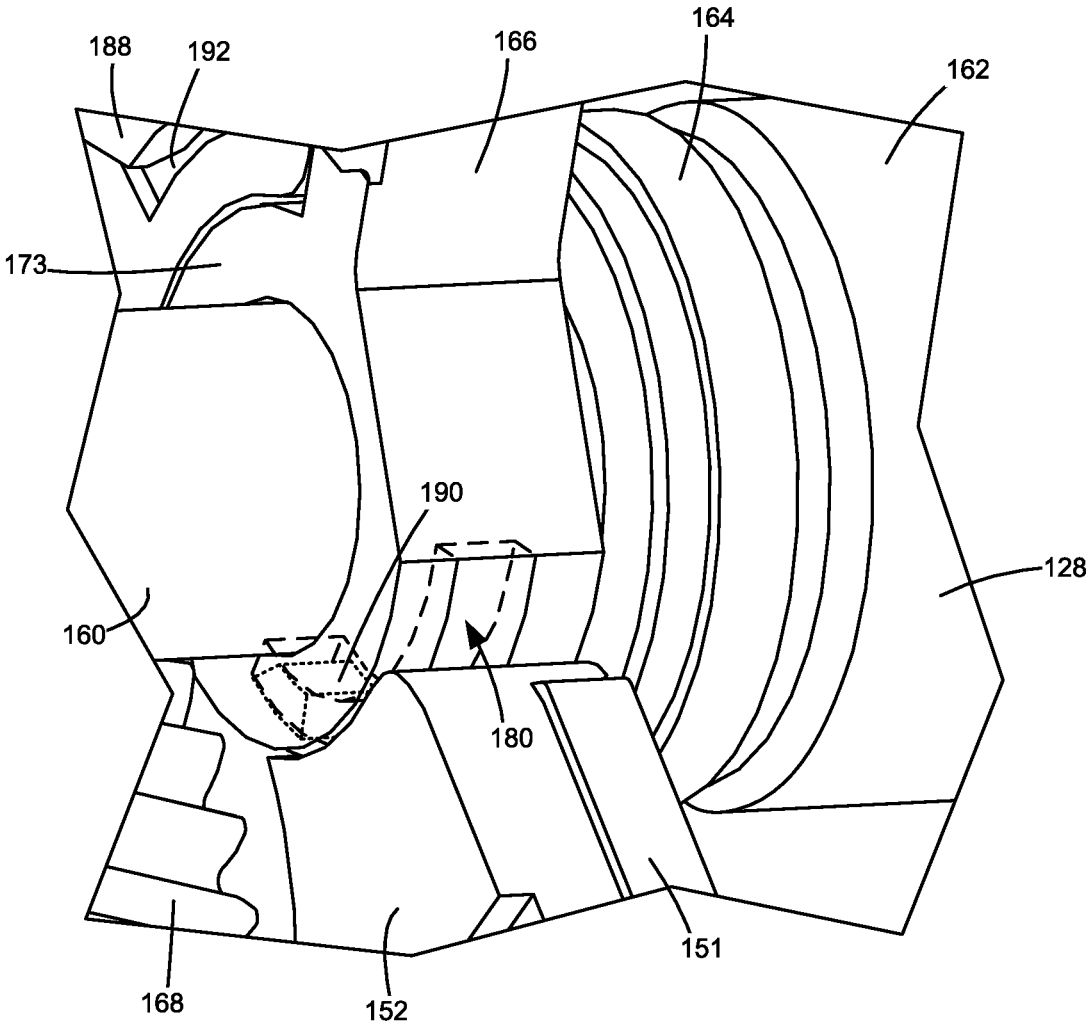
FIG. 10 is a perspective view showing axial alignment of the developer roll bushing according to one example embodiment.

As bushing 166 rotates upward, engagement between arm 188 and outer axial surface 193 of gear plate 152 in recess 192 initially provides coarse axial alignment of bushing 166 along rotational axis 129 of developer roll 128. As bushing 166 rotates further upward, tooth 190 in recess 158 enters groove 180 on body 170 of bushing 166. Contact between tooth 190 and the surfaces of body 170 forming groove 180 align bushing 166 axially (i.e., relative to rotational axis 129 of developer roll 128 and central axis 175 of opening 174) relative to housing 110. FIG. 10 shows bushing 166 in its final, installed position relative to housing 110 with tooth 190 positioned in groove 180.

Figure 11:
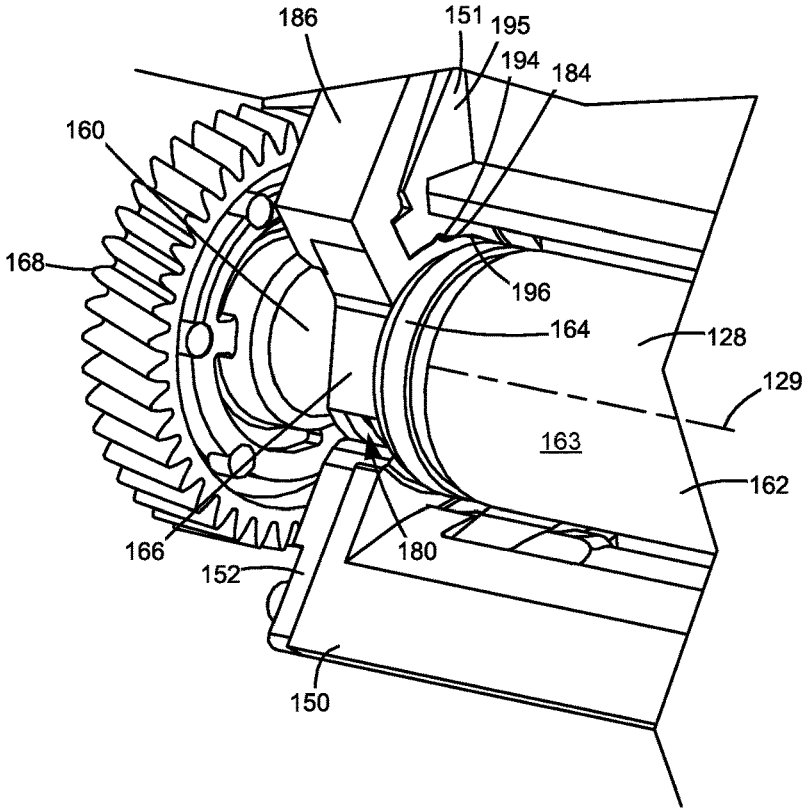
FIGS. 11 and 12 are perspective views showing the developer roll bushing installed on the developer unit according to one example embodiment.

With reference to FIGS. 9 and 11, a catch 194 is positioned to receive corresponding projection 182 of bushing 166 in order to position bushing 166 rotationally relative to housing 110, In the example embodiment illustrated, catch 194 is positioned on a concave surface 196 of end wall 151 of main body portion 150 that forms recess 158 in an upper portion of recess 158. In this embodiment, catch 194 is positioned at an inner axial surface 195 of end wall 151. As bushing 166 rotates upward during assembly onto housing 110, triangular projection 184 contacts and moves along concave surface 196 until triangular projection 184 reaches and enters catch 194 as shown in FIG. 11. The contact between triangular projection 184 and catch 194 helps prevent rotational movement of bushing 166 relative to housing 110 during operation and, in this manner, aligns bushing 166 rotationally relative to housing 110.

Figure 12:
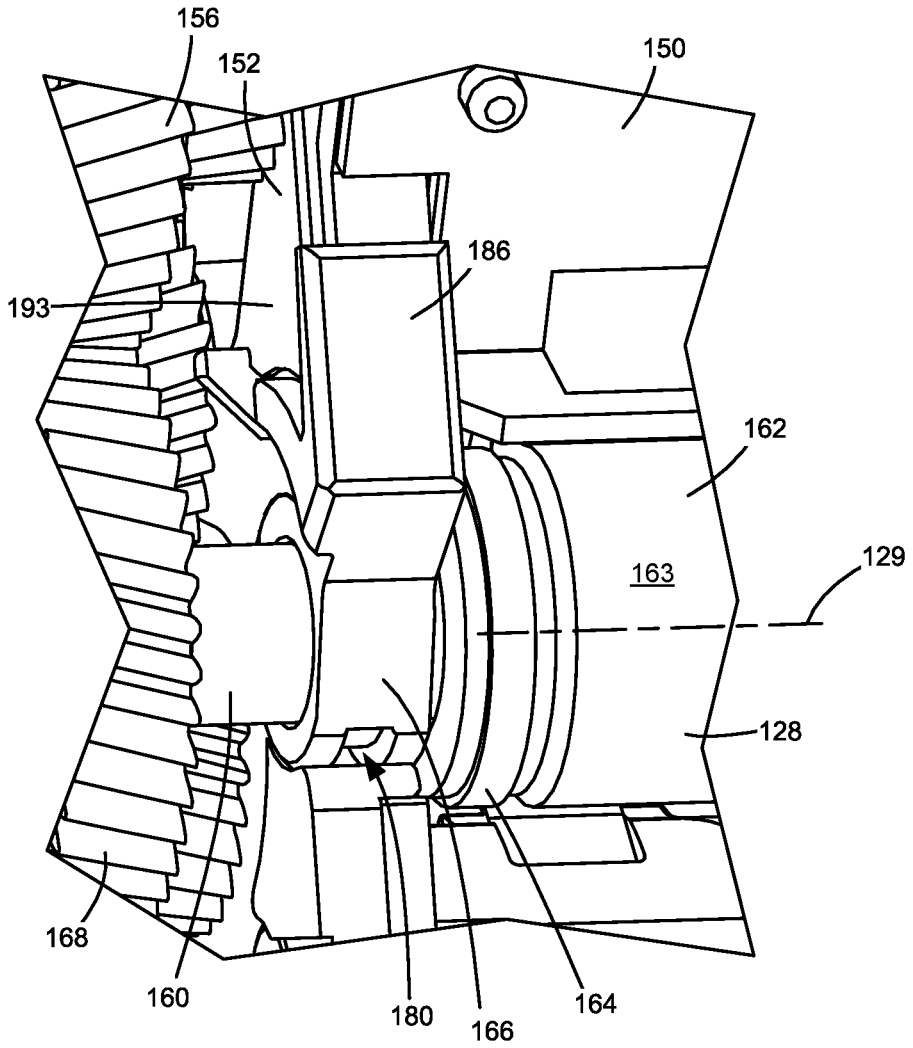

Bushing 167 at end 119 of housing 110 may include a similar construction and assembly method (or a different construction and/or assembly method) as bushing 166 at end 118 of housing 110. The installation of bushings 166, 167 onto housing 110 completes the installation of the developer roll subassembly, including shaft 160, roll body 162, spacers 164, 165 and bushings 166, 167, onto housing 110. With reference to FIGS. 11 and 12, after the developer roll subassembly is installed onto housing 110, drive gear 168 may be installed on shaft 160 of developer roll 128 axially outboard of bushing 166, and any other remaining gears of drive trains 156, 157 may be installed. After drive trains 156, 157 are installed, end caps 154, 155 may then be attached to main body portion 150 and/or gear plates 152, 153.

The use of bushings 166, 167 that are separable with developer roll 128 from housing 110 permits relatively simple removal and replacement of the developer roll subassembly if print defects attributable to a defective developer roll 128 occur during testing of toner cartridge 100 during manufacture. Further, the engagement between groove 180 of bushing 166 and tooth 190 of housing 110 to axially position bushing 166 relative to housing 110 helps minimize the amount of axial space occupied by bushing 166. This, in turn, helps minimize the overall length of toner cartridge 100 along the axial dimension of developer roll 128. In contrast, a bushing that relies on features that extend past outer axial surface 193 of gear plate 152 and inner axial surface 195 of main body portion 150 to locate the bushing axially would tend to occupy more space axially or could interfere with other components of toner cartridge 100, such as spacer 164 or drive gear 168.

While the example embodiment illustrated includes a female groove 180 on bushing 166 and a male tooth 190 on housing 110 that axially align bushing 166 to housing 110, this configuration may be reversed as desired to include a male feature on bushing 166 and a female feature on housing 110. Similarly, while the example embodiment illustrated includes a male projection 182 on bushing 166 and a female catch 194 on housing 110 to rotationally align bushing 166 to housing 110, this configuration may be reversed as desired to include a female feature on bushing 166 and a male feature on housing 110. Further, while the example embodiment illustrated includes a developer roll 128 that is positioned by bushings 166, 167 that are separable from a housing 110, it will be appreciated that other rotatable components of an image forming device may be positioned by separable bushings similar to bushings 166, 167 as desired.

Although the example embodiment illustrated includes a single replaceable unit in the form of toner cartridge 100 for each toner color, it will be appreciated that the replaceable unit(s) of the image forming device may employ any suitable configuration as desired. For example, in another embodiment, the main toner supply for the image forming device is provided in a first replaceable unit and the developer unit and photoconductor unit are provided in a second replaceable unit, Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations. Those skilled in the art will also appreciate that positional relationships described herein (e.g., above, below, top, bottom, etc.) refer to operative positions of the image forming device and its components.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly for an electrophotographic image forming device, comprising:

a housing;

a rotatable component having a shaft that defines a rotational axis of the rotatable component; and a bushing having an opening defined by an inner circumferential surface of the bushing, the shaft is received in the opening such that the inner circumferential surface of the bushing rotatably supports the shaft, the bushing is installed on the housing and is separable from the housing, a first mating feature is positioned on an outer surface of the bushing that is opposite the inner circumferential surface of the bushing, the first mating feature is positioned between an inner axial end of the bushing and an outer axial end of the bushing relative to the rotational axis of the rotatable component, the first mating feature of the bushing is in contact with a second mating feature on the housing, contact between the first and second mating features defines an axial position of the bushing relative to the housing along the rotational axis of the rotatable component, contact between the first and second mating features limits inward axial movement and outward axial movement of the bushing relative to the housing along the rotational axis of the rotatable component when the bushing is installed on the housing.

2. The assembly of claim 1, wherein contact between the first and second mating features includes a male feature of the second mating feature on the housing in contact with a female feature of the first mating feature of the bushing.

3. The assembly of claim 1, wherein the bushing includes a third mating feature positioned on the outer surface of the bushing, the third mating feature of the bushing is in contact with a fourth mating feature on the housing, contact between the third and fourth mating features defines a rotational position of the bushing relative to the housing.

4. The assembly of claim 3, wherein the first mating feature of the bushing is positioned on a lower portion of the bushing, and the third mating feature of the bushing is positioned on an upper portion of the bushing.

5. The assembly of claim 3, wherein the second mating feature on the housing is positioned on one of a gear plate of the housing and an end wall of a main body portion of the housing, and the fourth mating feature on the housing is positioned on the other of the gear plate of the housing and the end wall of the main body portion of the housing.

6. A developer unit for an electrophotographic image forming device, comprising:

a housing;

a rotatable developer roll having a shaft that defines a rotational axis of the developer roll; and a bushing having a cylindrical opening that extends through the bushing from an inner axial end of the bushing to an outer axial end of the bushing, the shaft extends through the cylindrical opening such that the bushing rotatably supports the shaft, the bushing is installed on a recess in the housing and is separable from the housing, the recess is defined by a concave surface of the housing, a groove is formed in an outer surface of the bushing and runs circumferentially relative to the rotational axis of the developer roll, the groove is positioned between the inner axial end of the bushing and the outer axial end of the bushing, the groove matably receives a tooth that projects from the concave surface of the housing, contact between the tooth and a surface of the bushing in the groove defines an axial position of the bushing relative to the housing along the rotational axis of the developer roll.

7. The developer unit of claim 6, wherein the groove is positioned on a lower portion of the bushing.

8. The developer unit of claim 6, wherein the bushing is installed rotationally on the housing.

9. The developer unit of claim 6, wherein the tooth projects from a gear plate of the housing.

10. The developer unit of claim 6, wherein the bushing includes a latching projection that extends radially outward relative to the rotational axis of the developer roll from the outer surface of the bushing, the latching projection contacts a catch positioned in the concave surface of the housing, contact between the catch and the latching projection of the bushing defines a rotational position of the bushing relative to the housing.

11. The developer unit of claim 10, wherein the tooth projects from a gear plate of the housing, and the catch is positioned on an end wall of a main body portion of the housing.

12. A developer roll bushing for an electrophotographic image forming device, comprising:

a body attachable to a housing in the electrophotographic image forming device;

a cylindrical opening extending through the body from an inner axial end of the body to an outer axial end of the body for receiving and rotatably supporting a shaft of a developer roll, the cylindrical opening is defined by an inner circumferential surface of the body; and a groove formed in an outer surface of the body that is opposite the inner circumferential surface of the body, the groove runs circumferentially relative to a central axis of the cylindrical opening, the groove is positioned between the inner axial end of the body and the outer axial end of the body, the groove is positioned to matably receive a tooth on the housing to define an axial position of the developer roll bushing relative to the housing along the central axis of the cylindrical opening.

13. The developer roll bushing of claim 12, wherein the groove is positioned on a lower portion of the body.

14. The developer roll bushing of claim 12, further comprising a latching projection that extends radially outward relative to the central axis of the cylindrical opening from the outer surface of the body, the latching projection is positioned to contact a catch on the housing to define a rotational position of the developer roll bushing relative to the housing.

15. The developer roll bushing of claim 14, wherein the groove is positioned on a lower portion of the body, and the latching projection is positioned on an upper portion of the body.

16. The developer roll bushing of claim 14, wherein the latching projection is positioned at the inner axial end of the body.

17. An assembly for an electrophotographic image forming device, comprising:

a housing;

a rotatable component having a shaft that defines a rotational axis of the rotatable component; and a bushing having an opening defined by an inner circumferential surface of the bushing, the shaft is received in the opening such that the inner circumferential surface of the bushing rotatably supports the shaft, the bushing is installed on the housing and is separable from the housing, a first mating feature is positioned on an outer surface of the bushing that is opposite the inner circumferential surface of the bushing, the first mating feature is positioned between an inner axial end of the bushing and an outer axial end of the bushing relative to the rotational axis of the rotatable component, the first mating feature of the bushing is in contact with a second mating feature on the housing, contact between the first and second mating features defines an axial position of the bushing relative to the housing along the rotational axis of the rotatable component, wherein contact between the first and second mating features includes a male feature of the second mating feature on the housing in contact with a female feature of the first mating feature of the bushing.

18. An assembly for an electrophotographic image forming device, comprising:

a housing;

a rotatable component having a shaft that defines a rotational axis of the rotatable component; and a bushing having an opening defined by an inner circumferential surface of the bushing, the shaft is received in the opening such that the inner circumferential surface of the bushing rotatably supports the shaft, the bushing is installed on the housing and is separable from the housing, a first mating feature is positioned on an outer surface of the bushing that is opposite the inner circumferential surface of the bushing, the first mating feature is positioned between an inner axial end of the bushing and an outer axial end of the bushing relative to the rotational axis of the rotatable component, the first mating feature of the bushing is in contact with a second mating feature on the housing, contact between the first and second mating features defines an axial position of the bushing relative to the housing along the rotational axis of the rotatable component, wherein the bushing includes a third mating feature positioned on the outer surface of the bushing, the third mating feature of the bushing is in contact with a fourth mating feature on the housing, contact between the third and fourth mating features defines a rotational position of the bushing relative to the housing.

19. The assembly of claim 18, wherein the first mating feature of the bushing is positioned on a lower portion of the bushing, and the third mating feature of the bushing is positioned on an upper portion of the bushing.

20. The assembly of claim 18, wherein the second mating feature on the housing is positioned on one of a gear plate of the housing and an end wall of a main body portion of the housing, and the fourth mating feature on the housing is positioned on the other of the gear plate of the housing and the end wall of the main body portion of the housing.

* * * * *